US005560571A

United States Patent [19]

Remington

[11] Patent Number: 5,560,571

[45] Date of Patent: Oct. 1, 1996

[54] REVERSIBLE WING INSERT FROG

[75] Inventor: James A. Remington, Superior, Wis.

[73] Assignee: ABC Rail Products Corporation, Chicago, Ill.

[21] Appl. No.: 537,607

[22] Filed: Oct. 2, 1995

[51] Int. Cl.[6] ..... E01B 7/00

[52] U.S. Cl. ..... 246/468; 246/460

[58] Field of Search ..... 246/454, 460, 246/461, 463, 468, 470, 471

[56] References Cited

U.S. PATENT DOCUMENTS

| | | | |
|---|---|---|---|
| 693,210 | 2/1902 | Angerer et al. | 246/460 |
| 747,955 | 12/1903 | Entwisle | 246/460 |
| 1,246,418 | 11/1917 | Goldsmith | 246/460 |
| 1,636,373 | 7/1927 | Leedom | 246/460 |
| 5,312,075 | 5/1994 | Kuhn | 246/468 |
| 5,456,430 | 10/1995 | Ortiz-Rivas | 246/460 |

*Primary Examiner*—Mark T. Le
*Attorney, Agent, or Firm*—Thomas S. Baker, Jr.

[57] ABSTRACT

A railroad trackwork railbound frog assembly having a toe point element is provided with a pair of spaced-apart wing rail elements each having a notch recess feature, a pair of reversible and interchangeable spaced-apart wing rail insert elements, usually fabricated of a manganese alloy steel or a high-strength, low-alloy steel material that is harder than the material from which the wing rail elements are manufactured, installed in abutting relation to the wing rail element notch recesses, spacer blocks that maintain the separations between the toe point, wing rail, and wing rail insert elements, and bolt-type fastener devices joining the elements of the frog assembly into a unitary structure.

14 Claims, 3 Drawing Sheets

REVERSIBLE WING INSERT FROG

FIELD OF THE INVENTION

This invention relates generally to railroad trackwork, and particularly concerns a novel railroad trackwork railbound frog assembly.

BACKGROUND OF THE INVENTION

A railroad trackwork frog assembly is typically inserted in railroad trackwork at the intersection of a mainline rail and a turnout rail to permit the flanges of railcar wheels moving along one of such rails to pass across the other. The frog assembly supports the wheels over tread surface omitted between the frog throat and the frog point, and provides flangeways for aligning the railcar wheels when passing over the frog point so that they will be afforded an adequate load-bearing support area at all times during wheel rail-crossing movement. Generally, standard turnout frogs may be classified as rigid frogs which have no movable parts or movable wing frogs in which one or both of the included wing elements move outward to provide the railcar wheel flangeway or flangeways.

As railcar wheels pass through the frog in either direction, they must pass over the opposite run flangeway from the frog point element to the frog wing element or from the frog wing element to the frog point element depending on the direction of movement. As this occurs, the vertical wheel loadings which the frog is subjected to are increased as a factor of the railcar speed; the resultant impact loadings are transmitted to the frog load-receiving tread surfaces. Such impact loadings, particularly in the case of frogs utilized in mainline heavy duty, high speed trackwork applications, often exceed the yield strength of the typical included railbound frog manganese casting and as a consequence unwanted frog tread surface deterioration begins.

Such deterioration may involve manganese alloy metal flows, metal chipping, and/or metal cracking that develop over a period of time directly related to such factors as traffic frequency, railcar wheel loads, turnout conditions, railcar wheel profiles, track alignment, tie and ballast conditions, initial integrity of the casting metal, adequacy of maintenance, repair materials and practices, and the like. In representative rail trackwork frog service, and depending on the traffic duty, the frog point element and one of the frog wing elements will deteriorate to an unacceptable degree and thereby require maintenance attention. When a frog manganese casting element deteriorates to a condition that is unrepairable, the entire frog assembly must be replaced or in some instances the casting is "changed-out" with the incorporating frog assembly still installed in the track. In either case, the maintenance procedure is costly. If the opposite wing element or the assembly frog point element were in a near-new condition it could be salvaged if it were a separate element.

It is an important object of the present invention to provide a railroad trackage rigid railbound frog assembly which may be utilized in a manner which results in a significant reduction of maintenance repair and replacement costs, and particularly when utilized in railroad trackage applications involving an industry mainline heavy duty, high speed class of traffic.

SUMMARY OF THE INVENTION

The novel railbound-type of rail trackwork frog assembly of this invention is essentially comprised of a pair of spaced-apart wing rails which are each provided with a wing insert-receiving notch recesses, a pair of spaced-apart wing inserts of particular planform which each co-operate with a respective wing rail and wing rail insert notch recess, such inserts normally being cast or machined using a conventional manganese alloy steel or a conventional high strength, low alloy steel material, and various spacer block elements and bolt-type fastener hardware that function to join such components into a unitary structure. The assembly further includes support structure such as conventional rail base plates or rail tie plates. In addition, the trackwork frog assembly of the present invention may advantageously also include a readily replaceable frog point element cast or machined using manganese steel or conventional high strength, low alloy steel.

It is important that each wing insert element have a planform that is symmetrical about both the wing insert longitudinal axis and wing insert lateral axis, and that such element planform be complementary to the planform of the insert recesses provided in the frog assembly wing rail elements. It is also important that fastener openings incorporated in the wing rail elements and in the wing insert elements be symmetrically positioned relative to the lateral axes of both the wing rail wing insert notch recesses and the wing inserts.

As a consequence, when an undesirable degree of wear or deterioration occurs in one or both of the two wing insert elements at particular locations, such elements may be interchanged, may be individually or together reversed in orientation, or may be individually replaced to thereby materially extend the useful total operating life of the frog assembly components.

Other advantages of the present invention will become apparent during a careful consideration of the drawings and detailed description which follow.

DETAILED DESCRIPTION

Figure 1:
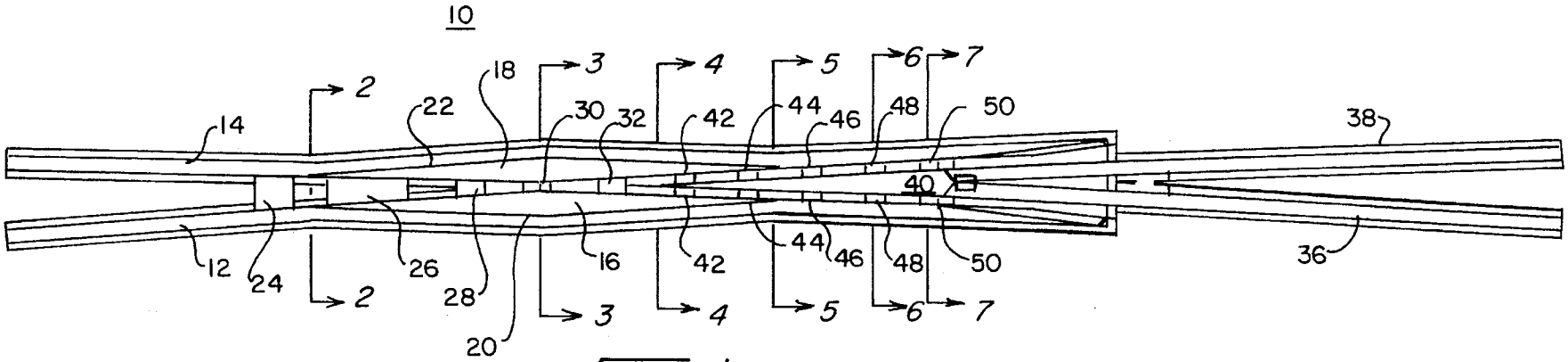
FIG. 1 is a plan view of a preferred embodiment of the reversible wing insert frog assembly of this invention.
Figure 2:
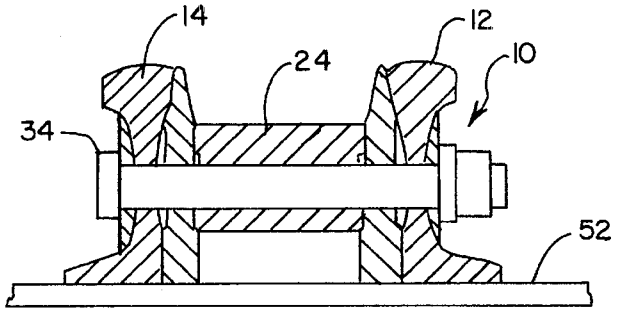
FIGS. 2 through 7 are section views taken at lines 2—2 through 7—7 of FIG. 1, respectively.
Figure 3:
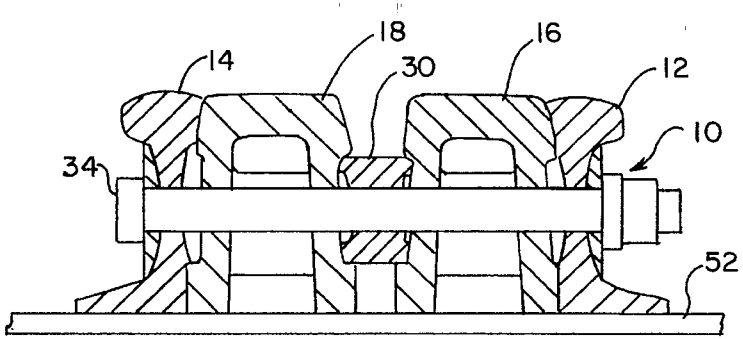
Figure 5:
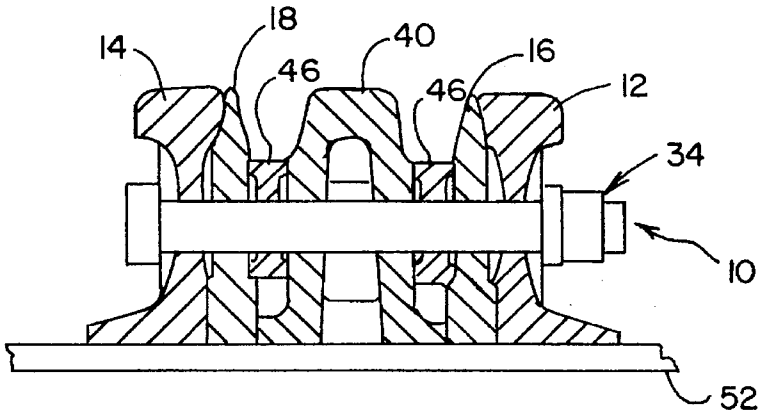
Figure 7:
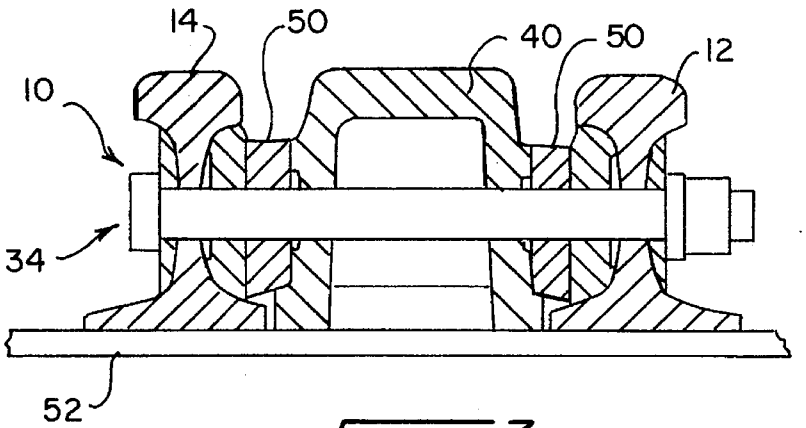
Figure 4:
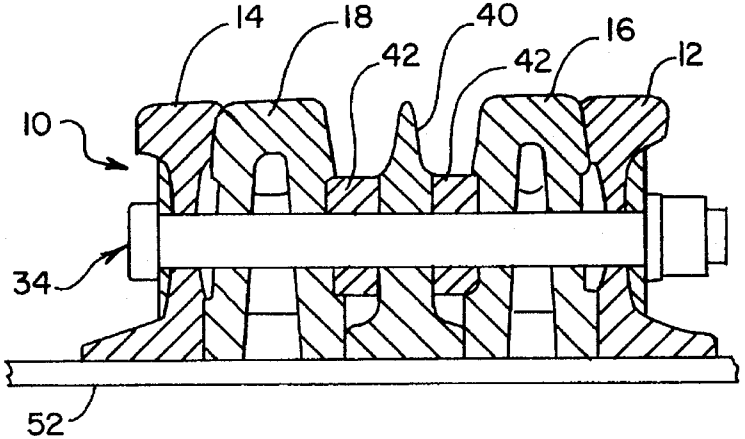
Figure 6:
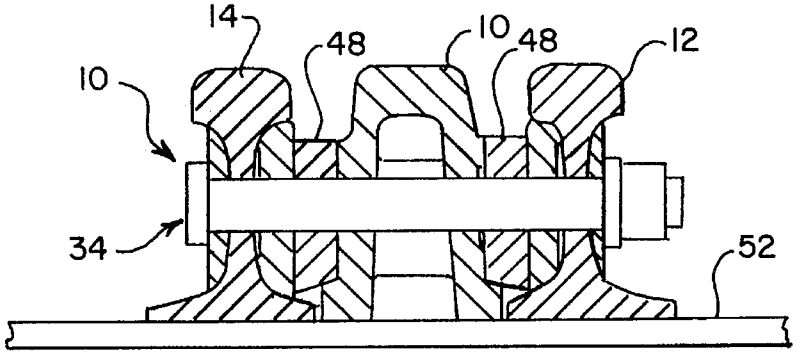

A preferred embodiment of the railroad trackwork frog assembly of the present invention is referenced generally as 10 in FIG. 1, and is essentially comprised of a pair of laterally spaced-apart right-hand and left-hand wing rail elements 12 and 14, respectively, a pair of laterally spaced-apart wing insert elements 16 and 18 which are positioned at a respective wing insert notch recess 20 or 22 provided in each of the wing rail elements. Various spacer block elements 24 through 32 are provided in frog assembly 10 to maintain the desired lateral separation between elements 12 through 22 when they are assembled into a unitary structure using threaded bolt and nut type fastener devices 34 (see FIGS. 2 through 5). Frog assembly 10 also typically includes a pair of heel rail elements 36 and 38, a replaceable point insert element 40 abutting the ends of heel rail elements 36, 38, and paired spacer block elements 42 through 50 which maintain the desired separation between cast point insert element 40 and wing rail elements 12 and 14 when such are joined into the unitary structure using additional fastener devices 34 (see FIGS. 5 through 7). Not shown in FIG. 1 of the drawings are the necessary conventional frog base plate or tie plate elements 52 (see FIGS. 2 through 7) which are essentially a part of a completed frog assembly 10 and to which the unitary structure of joined components 12 through 50 are secured for subsequent mounting on wooden or concrete ties in a conventional trackwork roadbed. Also, FIGS. 1 and 2 of the drawings do not illustrate the conventional rail clip and threaded bolt devices or the like which are utilized to securely join wing rail elements 12 and 14 to support elements 52 or conventional spike or bolt fasteners and the like for securing the frog support base or tie plates (52) to the roadbed ties that are actually used.

Figure 8:
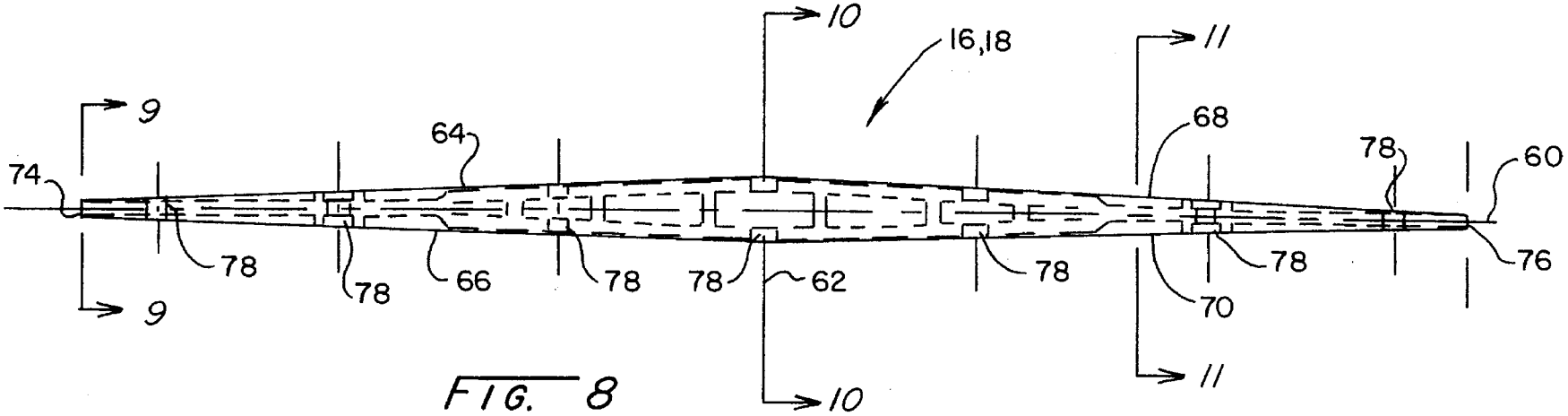
FIG. 8 is a plan view separately illustrating one of the two reversible and interchangeable frog insert elements shown in FIG. 1.

FIG. 8 illustrates an enlarged and detailed tread surface planform which pertains to each of the wing insert elements 16,18 shown in FIGS. 1 through 7. Each of the frog assembly cast wing inserts has a longitudinal axis 60, which is also an insert axis of symmetry, and a lateral axis 62 which likewise is an insert axis of symmetry. Planform side portions 64 through 70 which define the wing insert element planform are so located that side portions 64 and 66 are symmetrically positioned relative to each other and with respect to axis 60, planform side portions 68 and 70 likewise are symmetrically positioned relative to each other and with respect to axis 60, and the pair of side portions 64 and 66 are symmetrically positioned relative to the pair of side portions 68 and 70 and with respect to insert lateral axis 62. Thus, the planform of each wing insert 16,18 is essentially a equilateral parallelogram (rhombus having sides of equal length). Equally importantly, the included angle between side portions 64 and 66 equals the included angle between side portions 68 and 70, and such included angle is equal to the angle specified for the assembly 10 applicable A.R.E.A. (American Railroad Engineering Association) frog number. Also, it should be noted that each side portion of the wing insert 16,18 tread surface planform at one side of longitudinal axis 60 comprises an extension of the wing rail gage line or an extension of the wing rail guard line in either of the two different relative wear-receiving positions that it might be installed in assembly 10.

With respect to the planform of a wing insert 16,18, a rhomboid configuration (parallelogram with unequal adjacent sides) may advantageously be utilized instead of the equilateral parallelogram configuration but some of the element's versatility of use is compromised.

Figure 10:
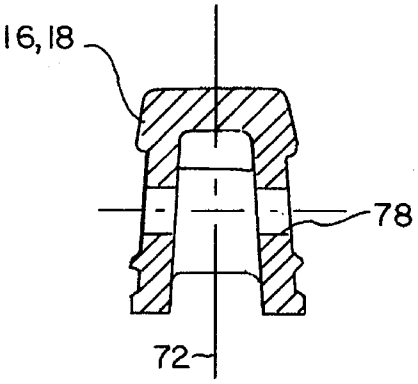
FIGS. 9 through 11 are section views taken at lines 9—9 through 11—11 of FIG. 8, respectively.
Figure 11:
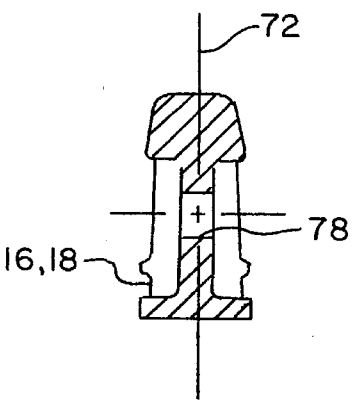
Figure 9:
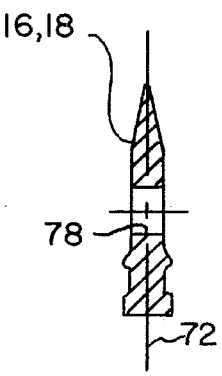

It should be noted in FIGS. 9 through 11 that the reversible wing inserts 16,18 have a vertical axis 72 which also is an exterior configuration axis of symmetry. Further, the ends 74 and 76 of each reversible wing insert element 16,18 are preferably "blunted" (preferably do not have a sharp-point configuration). Thus the notch recesses 20 and 22 included in wing rails 12 and 14, respectively, each have a configuration that is a replica of the configuration of that portion of the planform of reversible wing inserts 16,18 comprised of blunted ends 74 and 76 and side portions 64 and 68 or comprised of blunted ends 74 and 76 and side portions 66 and 70.

Also, it should be noted that the various bolt holes 78 provided in reversible wing insert 16,18 (and the correspondingly aligned bolt holes provided in wing rails 12,14 at their notch recess portions 20,22) are located at symmetrically distanced positions relative to lateral axis 62 so that upon wing insert removal, reversal, and reinstallation, the bolt holes in inserts 16,18 will remain aligned with the bolt holes previously provided in the notch recess portions 20,22 of wing rail elements 12,14. The various reinforcing or cross ribs that are provided in reversible wing inserts 16,18, although illustrated, are not given reference numerals in FIGS. 8 through 11. Not illustrated in the drawings are the various conventional false flange ramps typically incorporated into the heel riser, wing rail, and frog point components of a railbound frog assembly. Such do not comprise a critical part of the inventive concept of this application.

Numerous different wear cycles may be experienced by the right-hand and left-hand wing rail elements 12,14 and their respective wing insert elements 16,18 over a prolonged period of usage. In a frog assembly 10 wherein the predominant traffic pattern is a trailing wheel path from the left-hand heel rail 38 onto wing insert element 16 and its associated wing rail element 12, the rail car wheel impacts element 16 at its frog heel end portion (portion nearest frog point element 40) and imparts more of a rolling load, and thus reduced wear or deterioration, at the frog toe end portion of wing insert element 16. Over a period of time the frog heel end of element 16 will likely deteriorate due to an observed undesirable condition of integrity due to the repeated impact loading.

At that time, wing insert element 16 may be removed from the frog assembly, rotated 180° about its vertical axis of symmetry 72, and re-installed in assembly 10 using the same fastener elements 34. The heel end portion of element 16 is thus newly located in a position whereat it will subsequently receive predominantly only railcar wheel rolling loads and the less worn former frog toe end portion will subsequently receive the wheel impact loadings, thus providing extended operational life to the individual component.

During the two cycles just described, wing insert element 18 may be receiving little or no wheel loadings depending on the type of frog assembly 10 service actually experienced. As wing insert element 16 nears the end of its serviceability under the loaded condition, elements 16 and 18 can be interchanged to further the life cycle of the entire assembly by placing the relatively unworn wing insert element 18 in the rail line of heavy traffic (wing rail element 12 and heel rail 38). Element 16 then functions in wing rail element 14 primarily as a spacer for the entire assembly and until such time as it is desired to replace both worn components 16 and 18 and usually also the replaceable toe point element 40.

Particular changes may be made in the hereinbefore-described railbound frog assembly having reversible wing rail insert elements without departing from the scope of my invention, and it is intended that all matters contained in the description or shown in the accompanying drawings shall be interpreted as illustrative and not in a limiting sense.

I claim my invention as follows:

1. In a railroad trackwork railbound frog assembly, in combination:

a frog toe point element;

a pair of spaced-apart wing rail elements each being spaced apart from said frog toe point element and each having a gage reference line, a guard reference line and a wing insert notch recess;

a pair of spaced-apart wing rail insert elements each abutting one of said wing rail element wing insert notch recesses;

spacer block elements separating said toe point element, said wing rail elements, and said wing rail insert elements from each other to provide railcar wheel flangeways; and bolt-type fastener elements joining said toe point element, said wing rail elements, said wing rail insert elements, and said spacer block elements into a unitary structure, said wing rail insert elements each having a tread surface planform parallelogram configuration with two side portions that are extensions of the gage reference line and the guard reference line of one of said wing rail elements.

2. The invention defined by claim 1 wherein said wing rail insert element tread surface planform parallelogram configurations are each an equilateral parallelogram configuration.

3. The invention defined by claim 1 wherein said toe point element is separate from said wing rail insert elements and is fabricated of a manganese alloy steel.

4. The invention defined by claim 1 wherein said wing rail insert elements are separate from said wing rail elements and are fabricated of a manganese alloy steel.

5. The invention defined by claim 1 wherein said toe point element is separate from said wing insert elements and is fabricated of a high-strength, low-alloy steel.

6. The invention defined by claim 1 wherein said wing rail insert elements are separate from said wing rail elements and are fabricated of a high-strength, low-alloy steel.

7. The invention defined by claim 1 wherein said wing rail insert elements each have a longitudinal axis of symmetry and a lateral axis of symmetry, and wherein said wing rail insert elements each has a tread surface parallelogram configuration that is symmetrical with respect to both said longitudinal axis of symmetry and said lateral axis of symmetry.

8. The invention defined by claim 1 wherein said wing rail insert element tread surface planform parallelogram configurations each has an acute angle at two opposite apices.

9. The invention defined by claim 1 wherein said wing rail insert element tread surface planform parallelogram configuration each has an acute angle at two opposite apices, each acute angle being terminated by a blunt wing rail insert tip.

10. The invention defined by claim 7 wherein said bolt-type fastener elements are positioned at locations along said wing rail insert element longitudinal axis of symmetry that are symmetrically distanced from said wing rail insert element lateral axis of symmetry.

11. In a railroad trackwork railbound frog assembly, in combination:

a self-supporting wing rail element having a gage reference line and a guard reference line and having a notch recess with two recess sides that are each parallel to one of said reference lines;

a self-supporting replaceable wing rail insert element abutting said wing rail element at said wing rail element notch recess sides, said wing rail insert element being an individually formed element that is separable from and removable from said frog assembly; and said wing rail insert element having a tread surface planform parallelogram configuration wherein two intersecting parallelogram configuration sides each comprise an extension of one of said wing rail element gage and guard reference lines.

12. The invention defined by claim 11 wherein said wing rail insert element tread surface planform parallelogram configuration is an equilateral parallelogram configuration.

13. A railroad trackwork frog assembly wing rail insert element having a tread surface planform parallelogram configuration, said configuration having a two intersecting side portions that comprise extensions of a wing rail gage reference line and of a wing rail guard reference line when the wing rail insert is incorporated into a railroad trackwork frog assembly wing rail element, and said wing rail insert element being an individually formed element.

14. The wing rail insert element defined by claim 13 wherein said tread surface planform parallelogram configuration is an equilateral parallelogram configuration.

* * * * *